US010843055B2

(12) United States Patent
Barnes

(10) Patent No.: US 10,843,055 B2
(45) Date of Patent: Nov. 24, 2020

(54) BASKETBALL GAME SYSTEM

(71) Applicant: Aaron Barnes, Matteson, IL (US)

(72) Inventor: Aaron Barnes, Matteson, IL (US)

( * ) Notice: Subject to any disclaimer, the term of this patent is extended or adjusted under 35 U.S.C. 154(b) by 471 days.

(21) Appl. No.: 14/860,272

(22) Filed: Sep. 21, 2015

(65) Prior Publication Data

US 2016/0082330 A1 Mar. 24, 2016

Related U.S. Application Data

(60) Provisional application No. 62/054,347, filed on Sep. 23, 2014.

(51) Int. Cl.

| | |
|---|---|
| ***A63B 63/08*** | (2006.01) |
| ***A63B 63/00*** | (2006.01) |
| ***A63B 71/04*** | (2006.01) |

(52) U.S. Cl.

CPC ..... *A63B 63/083* (2013.01); *A63B 71/04* (2013.01); *A63B 2063/001* (2013.01); *A63B 2209/10* (2013.01); *A63B 2210/50* (2013.01)

(58) Field of Classification Search

CPC ... A63B 63/083; A63B 63/08; A63B 2208/12; A63B 69/0071; A63B 2243/0037; A63B 2063/001; A63B 67/002

See application file for complete search history.

(56) References Cited

U.S. PATENT DOCUMENTS 921,366 A 5/1909 Conolly et al.
922,717 A 5/1909 Parker
1,162,140 A 11/1915 Cusick
1,198,300 A 9/1916 Watkins
1,439,199 A * 12/1922 Spilman ..... A63F 7/0612 124/7
1,574,201 A 2/1926 Lynch
1,765,269 A 6/1930 Hatley
1,903,254 A 3/1933 Bishop
(Continued)

FOREIGN PATENT DOCUMENTS

CN 103692444 A 4/2014
DE 3709945 A1 10/1988
(Continued)

OTHER PUBLICATIONS

International Search Report and Written Opinion for Application No. PCT/US15/51250 rendered by the International Searching Authority dated Feb. 3, 2016, 17 pages.

*Primary Examiner* — Melba Bumgarner
*Assistant Examiner* — Amir A Klayman
(74) *Attorney, Agent, or Firm* — Skaar Ulbrich Macari, P.A.

(57) ABSTRACT

The indoor basketball game system includes a multi-paneled folding backboard with a basketball hoop disposed on it. A winged ball deflector is disposed on the ground adjacent the bottom of the backboard and inclined upwards on the board from the bottom edge to form a ball return feature. The ball return feature of the present system via the deflector allows repeated shooting without worrying about chasing down the ball after every shot. Folding side panels of the backboard pivot to provide blocking sides and stability to the backboard, and can be angled to allow the player to shoot from many different positions. The backboard and deflector can be collapsed for storage and transport.

19 Claims, 10 Drawing Sheets

(56) References Cited

U.S. PATENT DOCUMENTS 1,924,757 A 8/1933 Shisoff
1,954,838 A * 4/1934 Woolsey ..... A63F 7/06 273/129 R
2,037,416 A 4/1936 Hull
2,114,777 A 4/1938 Englerth
2,278,616 A 4/1942 Kettering
2,424,016 A 7/1947 Botts
2,534,067 A 12/1950 Herbert
2,617,653 A 11/1952 Keller
2,660,157 A 11/1953 Binks
2,700,379 A 1/1955 Brigati
2,802,667 A 8/1957 Bertley
2,805,070 A 9/1957 Waters
2,850,283 A 9/1958 Lemelson
2,889,149 A * 6/1959 Williams ..... A63B 63/083 273/396
2,895,737 A 7/1959 Blees
3,018,769 A 1/1962 Parsoneault
3,194,556 A 7/1965 Vinson
3,233,896 A 2/1966 King
3,300,215 A 1/1967 Coffey, Sr.
3,308,802 A 3/1967 Applegate
3,544,110 A 12/1970 Dickinson
3,549,148 A 12/1970 Schloss
3,561,762 A 2/1971 Russell
3,572,308 A 3/1971 Smith
3,647,213 A 3/1972 Baker
3,659,576 A 5/1972 Eade et al.
3,717,342 A 2/1973 Haney et al.
3,776,550 A 12/1973 McNabb
3,806,122 A * 4/1974 Jones ..... A63B 63/00 273/331
3,814,421 A 6/1974 Spier, Jr.
3,841,631 A 10/1974 Dolan
3,899,173 A 8/1975 Zaris
3,901,506 A * 8/1975 Caveney ..... A63B 63/083 473/433
3,913,598 A * 10/1975 Glutting, Jr. ..... E04H 1/1205 135/117
3,913,916 A 10/1975 Martin, Jr.
3,917,263 A 11/1975 Wiley
3,918,711 A 11/1975 Zak
3,945,638 A 3/1976 Luebkeman
3,967,819 A 7/1976 Lewis
4,000,898 A 1/1977 Cooter
4,022,472 A * 5/1977 Seals ..... A63F 9/0204 273/400
4,025,074 A 5/1977 Hodges
4,036,494 A * 7/1977 Hayes ..... A63B 63/083 16/259
4,085,841 A 4/1978 Matsuyama
4,089,525 A 5/1978 Palazzolo
4,243,229 A 1/1981 Huser et al.
4,280,697 A 7/1981 Yuasa
4,291,885 A 9/1981 Cohen
4,352,348 A 10/1982 Griffith
4,372,284 A 2/1983 Shannon et al.
4,561,414 A 12/1985 Nozato
4,579,339 A 4/1986 Grimm
4,579,340 A 4/1986 Jenkins et al.
4,595,199 A 6/1986 Offutt
4,667,957 A 5/1987 Joseph
4,678,189 A 7/1987 Koss
4,697,810 A 10/1987 Mathison
4,706,954 A 11/1987 Kershaw
4,714,248 A 12/1987 Koss
4,720,101 A 1/1988 Farkas, Jr.
4,747,597 A 5/1988 Kluczny
4,786,371 A 11/1988 Postol
4,805,917 A 2/1989 Cochran
4,838,549 A 6/1989 Woodall
4,869,502 A 9/1989 Wares
4,896,882 A 1/1990 Coleman
4,913,431 A 4/1990 Jakobs
4,915,380 A 4/1990 Ackerman
4,936,577 A 6/1990 Kington et al.
4,940,231 A 7/1990 Ehler
4,957,289 A 9/1990 Kotlarz
4,995,374 A 2/1991 Black
5,016,875 A 5/1991 Joseph
5,042,820 A 8/1991 Ford
5,050,574 A 9/1991 Ramirez
5,060,940 A * 10/1991 Mullen ..... A63B 63/083 273/396
5,069,460 A 12/1991 Kulesza
5,104,124 A 4/1992 Bernard et al.
5,123,642 A 6/1992 Stokes
5,133,546 A 7/1992 Matherne et al.
5,141,224 A 8/1992 Nolde et al.
5,165,680 A 11/1992 Cass
5,171,009 A 12/1992 Filewich et al.
5,183,253 A 2/1993 Grimaldi et al.
5,184,814 A 2/1993 Manning
5,224,699 A 7/1993 Zaruba
5,246,225 A 9/1993 Matherne et al.
5,257,780 A 11/1993 Cook et al.
5,273,275 A * 12/1993 Wilkerson ..... A63B 63/083 473/433
5,273,276 A 12/1993 Warren
5,310,176 A 5/1994 Berg
5,312,099 A 5/1994 Oliver, Sr.
5,326,094 A 7/1994 Quinn
5,333,853 A 8/1994 Rektor
5,348,290 A 9/1994 Matherne et al.
5,364,091 A 11/1994 Sebek
5,374,054 A * 12/1994 Suess ..... A63B 63/083 473/433
5,382,017 A 1/1995 Pippert
5,393,049 A 2/1995 Nelson
5,401,015 A 3/1995 Woodall
5,409,211 A 4/1995 Adamek
5,443,259 A 8/1995 Segan
5,480,147 A 1/1996 Ethier et al.
5,487,540 A 1/1996 Bixler et al.
5,536,003 A * 7/1996 Brenner ..... A63B 63/083 273/402
5,540,428 A 7/1996 Joseph
5,556,106 A 9/1996 Jurcisin
5,642,879 A 7/1997 Rodriguez
5,658,211 A 8/1997 Glover
5,665,016 A 9/1997 Burnett
5,692,976 A 12/1997 Yu
5,746,668 A 5/1998 Ochs
5,776,018 A 7/1998 Simpson et al.
5,779,569 A 7/1998 Townsend et al.
5,803,837 A 9/1998 Lofaso, Sr.
5,813,926 A 9/1998 Vance
5,830,088 A 11/1998 Franklin De Abreu
5,971,873 A 10/1999 Balducci
6,045,463 A 4/2000 Cass
6,056,652 A 5/2000 Lees et al.
6,074,313 A 6/2000 Pearson
6,082,736 A 7/2000 Barlow
6,224,504 B1 5/2001 Tien
6,241,628 B1 6/2001 Jenkins et al.
6,267,696 B1 7/2001 Mabe et al.
6,319,145 B1 11/2001 Coughlan
6,458,049 B2 10/2002 Bush
6,536,770 B1 3/2003 Yang
6,537,161 B2 3/2003 Manix et al.
6,565,460 B2 5/2003 Wang
6,698,441 B1 * 3/2004 Zheng ..... A63B 9/00 135/117
6,746,348 B2 6/2004 Barnes et al.
6,752,728 B1 6/2004 Tien
6,761,649 B1 7/2004 Medley, Jr.
6,811,500 B2 11/2004 Tien
6,843,738 B2 1/2005 Spencer
6,918,591 B2 7/2005 D'Amico et al.
6,929,569 B1 8/2005 Wang
6,958,022 B2 10/2005 O'Neill et al.
6,991,566 B1 * 1/2006 McKinney, Sr. .. A63B 69/0097 473/459

(56) References Cited

U.S. PATENT DOCUMENTS

| | | | | |
|---|---|---|---|---|
| 7,056,237 | B2 | 6/2006 | Slavey et al. | |
| 7,086,189 | B2 * | 8/2006 | Morris | G09F 7/02 40/299.01 |
| 7,175,548 | B2 | 2/2007 | McNulty | |
| 7,201,676 | B2 | 4/2007 | Rumfola, III | |
| 7,207,906 | B1 | 4/2007 | Gregory | |
| 7,247,105 | B2 | 7/2007 | Huntsberger | |
| 7,258,633 | B2 | 8/2007 | Joseph et al. | |
| 7,404,562 | B2 | 7/2008 | Chen et al. | |
| 7,448,969 | B2 | 11/2008 | Weber et al. | |
| 7,487,971 | B2 * | 2/2009 | Angles | F41J 1/10 273/407 |
| 7,488,280 | B2 | 2/2009 | Aresenault | |
| 7,510,492 | B2 | 3/2009 | Hudson | |
| 7,553,244 | B2 | 6/2009 | York | |
| 7,682,268 | B2 | 3/2010 | Zheng | |
| 7,691,015 | B2 | 4/2010 | Nye et al. | |
| 7,736,250 | B2 | 6/2010 | O'Neill et al. | |
| 7,794,338 | B2 | 9/2010 | Cherry | |
| 7,841,957 | B1 | 11/2010 | Wares | |
| 7,927,237 | B2 | 4/2011 | Jenkins et al. | |
| 7,938,746 | B2 | 5/2011 | Chipperfield | |
| 8,123,634 | B1 | 2/2012 | Lovett | |
| 8,128,517 | B2 | 3/2012 | Blair | |
| 8,206,246 | B2 | 6/2012 | Joseph et al. | |
| 8,460,131 | B2 | 6/2013 | Harvey | |
| 8,852,030 | B2 | 10/2014 | Campbell et al. | |
| 8,876,637 | B2 | 11/2014 | Atkins | |
| 9,017,188 | B2 | 4/2015 | Joseph et al. | |
| 9,022,016 | B1 | 5/2015 | Hafer et al. | |
| D736,523 | S | 8/2015 | St. Laurent | |
| 9,192,842 | B2 | 11/2015 | Alger | |
| 9,227,125 | B2 | 1/2016 | Le | |
| 9,233,292 | B2 | 1/2016 | Joseph et al. | |
| 2004/0058756 | A1 | 3/2004 | Huang | |
| 2004/0160011 | A1 | 8/2004 | Fitzgerald | |
| 2006/0003855 | A1 | 1/2006 | Kershaw | |
| 2006/0016442 | A1 | 1/2006 | Wilson | |
| 2006/0016468 | A1 | 1/2006 | Zheng | |
| 2006/0040770 | A1 * | 2/2006 | Chou | A63B 69/0071 473/433 |
| 2006/0070608 | A1 | 4/2006 | Haas | |
| 2007/0026976 | A1 | 2/2007 | Nye et al. | |
| 2007/0037638 | A1 | 2/2007 | Rumfola, III | |
| 2007/0202969 | A1 | 8/2007 | Girard | |
| 2008/0042358 | A1 | 2/2008 | Chen et al. | |
| 2009/0062040 | A1 | 3/2009 | Gayed | |
| 2009/0069124 | A1 * | 3/2009 | Forlini | A63B 69/0071 473/435 |
| 2009/0203472 | A1 | 8/2009 | Snyder | |
| 2009/0227402 | A1 | 9/2009 | Chen | |
| 2010/0184539 | A1 | 7/2010 | Velardi | |
| 2010/0210379 | A1 | 8/2010 | Shelley | |
| 2010/0248866 | A1 | 9/2010 | Johnson et al. | |
| 2010/0285906 | A1 * | 11/2010 | Wares | A63B 69/0071 473/433 |
| 2011/0127716 | A1 | 6/2011 | Egan et al. | |
| 2012/0142458 | A1 | 6/2012 | He et al. | |
| 2012/0325193 | A1 | 12/2012 | Leal et al. | |
| 2013/0228138 | A1 | 9/2013 | Hamill et al. | |
| 2015/0290513 | A1 | 10/2015 | Robinson | |

FOREIGN PATENT DOCUMENTS

| | | | |
|---|---|---|---|
| DE | 10330497 | A1 | 2/2005 |
| EP | 0136217 | A1 | 4/1985 |
| EP | 0360896 | A1 | 4/1990 |
| GB | 2095565 | A | 10/1982 |
| WO | 1987002018 | A1 | 4/1987 |
| WO | 1992006747 | A2 | 4/1992 |
| WO | 1995032033 | A1 | 11/1995 |
| WO | 2015077351 | A2 | 5/2015 |
| WO | 2015120492 | A2 | 8/2015 |

* cited by examiner

BASKETBALL GAME SYSTEM

PRIORITY

This application claims the benefit of U.S. Provisional Application Ser. No. 62/054,347, filed on Sep. 23, 2014, which is hereby incorporated herein by reference in its entirety.

FIELD

The present invention relates generally to sports games and, more particularly, to a portable indoor basketball game system.

BACKGROUND

There are many different types of hoop games for indoor use. However, they typically have tiny hoops and balls, which limits the success of the player and often causes frustration because of a lack of success. Often, players may resort to simply dunking the ball to achieve success. Some of the conventional games have parts that protrude out onto the playing surface, which presents a tripping hazard and limits the normal play of authentic basketball. Many of the games must be hung on a wall, a door, or a bed, which limits the portability of the game. Also, games that are hung may result in significant holes in walls after a player falls into the game. If the game is improperly attached, it may fall and cause injuries. A few of the games require the player to crawl or bend while playing the game, which does not represent authentic basketball. Some of the games require a lot of space, and most families do not have correspondingly large houses with adequate play area. Therefore, there is a continuing need to provide an improved indoor basketball game system.

SUMMARY

Disclosed in one embodiment is an indoor basketball game system that in certain embodiments generally comprises a vertically-extending tri-fold backboard with a basketball hoop disposed on it. A winged ball deflector is disposed on the ground adjacent the bottom of the backboard and inclined upwards on the board from the bottom edge. The ball return feature of the present system via the deflector allows repeated shooting without worrying about chasing down the ball after every shot. Each vertical side of the game when in use encompasses an almost 120 degree arc, which allows the player to shoot from many different positions.

The basketball shooter does not have to chase after the ball after each shot because the ball rolls back toward the shooter. The goal (hoop) is 16 inches in diameter, which is bigger than those of the prior art, and it is not attached to a door, or wall; it is free standing. The bigger hoop allows for more success; thereby, increases the enjoyment of the game. The shooter does not have to stand right in front of the goal because the goal expands 120 degrees to allow shooting from multiple directions. The game is VERY portable; it is light weight, 12 lbs., folds flat, only requires the space of a bedroom dresser, and can be assembled in 2-3 minutes.

The disclosure includes an indoor basketball game system. The system includes a backboard. The backboard comprises a center section having a front surface and a back surface, a first side section and a second side section. The first side section is disposed along a first vertical side edge of the center section. The second side section is disposed along an opposing second vertical side edge of the center section. Each of the first side section and the second side section are coupled to the center section to pivot with respect to the center section about a vertical axis. A ball deflector is coupled to the backboard. The ball deflector comprises a center portion, a first arm and a second arm. The first arm is disposed along a first side edge of the center portion. The second arm is disposed along an opposing second side edge of the center portion. Each of the first arm and the second arm are coupled to the center portion to pivot with respect to the center portion along a respective first side edge and second side edge of the center portion. A basketball hoop assembly is disposed on the front surface of the center section of the backboard. The hoop assembly includes a rim pivotably coupled to a mounting plate such that the rim can be folded flat against the center section of the backboard. The ball deflector can be secured to the backboard such that a plane of the center portion forms an angle of more than 90 degrees with respect to the front surface of the backboard center portion.

The disclosure further includes an indoor basketball game kit. The kit includes a backboard comprising a center section, a first side section and a second side section. The first side section is pivotably secured to the center section along a first side edge of the center section. The second side section is pivotably secured to the center section along an opposing second side edge of the center section. A ball deflector is removably securable to the backboard. The ball deflector includes a center portion, a first arm and a second arm. The first arm is pivotably secured to the center portion along a first side edge of the center portion. The second arm is pivotably secured to the center portion along an opposing second side edge of the center portion. A basketball hoop assembly includes a rim pivotably coupled to a mounting plate. A plurality of apertures are defined in the center section of the backboard to permit securing of the mounting plate of the hoop assembly to the backboard.

Also disclosed is a method of shooting a basketball at a hoop indoors. The method includes providing a backboard center section. The center section defined a first vertical edge, an opposing second vertical edge, a front surface and a rear surface. A first side section is secured to the backboard center portion along the first vertical edge such that the first side section can pivot about the first vertical edge with respect to the center section. A second side section is secured to the backboard center portion along the second vertical edge such that the second side section can pivot about the second vertical edge with respect to the center section. A ball deflector is secured to the backboard center section such that the ball deflector intersects with the center section to form an angle of greater than 90 degrees therebetween. A basketball hoop assembly is secured to the backboard center section. A basketball is shot at the hoop assembly and contacts the hoop assembly. Then the ball is deflected towards a location where the basketball was shot.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
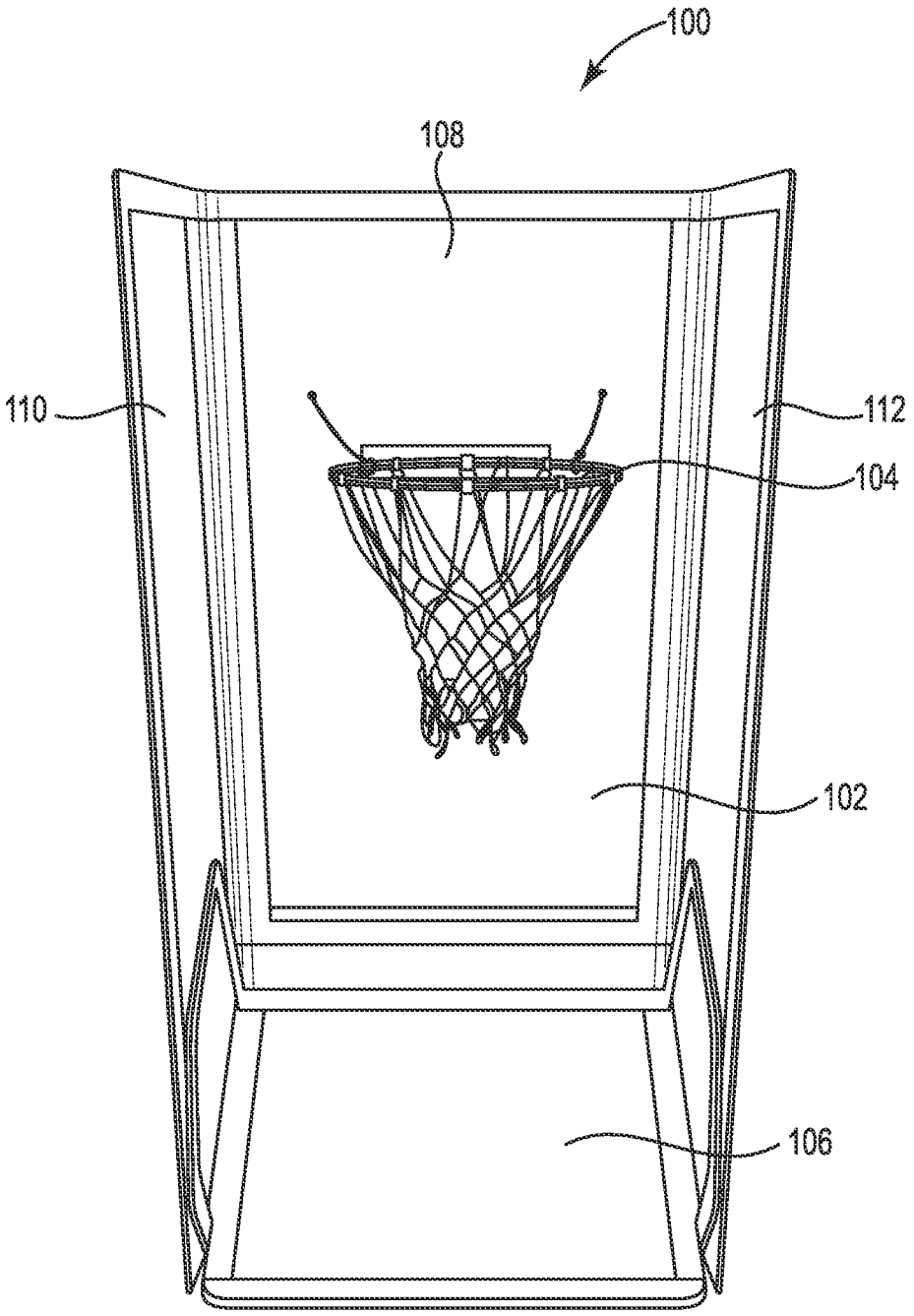
FIG. 1 is a front view of a basketball game system according to an example embodiment.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Dimensions and relative proportions of components are merely example embodiments and can be varied unless specifically limited in a given claim. Thus, the dimensions can be varied without departing from the scope of the invention.

As can be seen throughout FIGS. 1-12, the indoor basketball game system 100 generally comprises a vertically-extending tri-fold backboard 102 with a basketball hoop 104 disposed on the backboard. A winged ball deflector 106 is disposed on the ground adjacent the bottom of the backboard 102 and inclined upwards on the board 102.

The center portion 108 of the backboard 102 is generally planar and extends vertically. The side portions 110 and 112 are also generally planar and are disposed on each of the lateral vertical edges of the center portion 108. The side portions 110 and 112, or arms, can be pivoted about the vertical axis (at the vertical edges of the center panel 108) to form a range of angles with respect to the center section. This allows the sides to both contain errant shots and to support the backboard 102 in a free-standing position.

Figure 8:
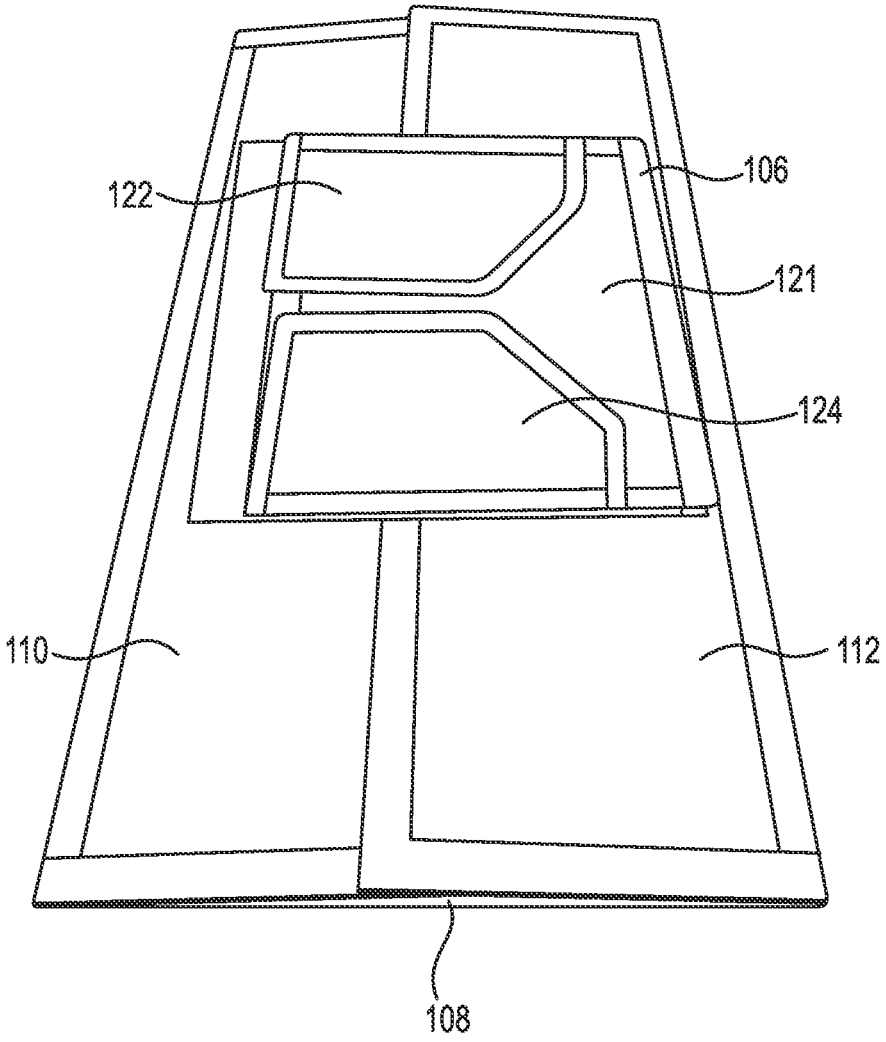
FIG. 8 is a perspective view of a basketball game system in a collapsed state according to an example embodiment.
Figure 9:
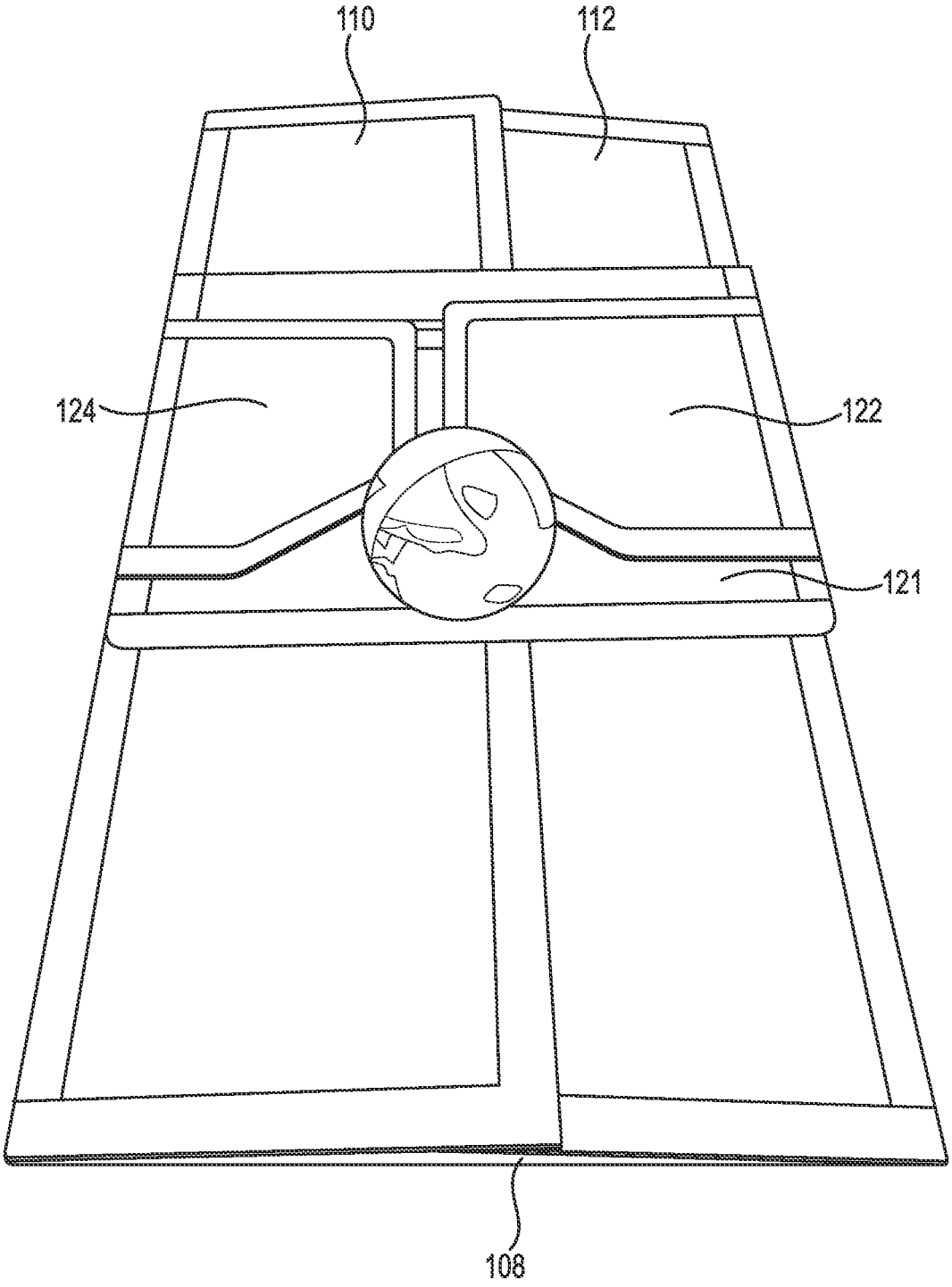
FIG. 9 is another perspective view of a basketball game system in a collapsed state according to an example embodiment.
Figure 10:
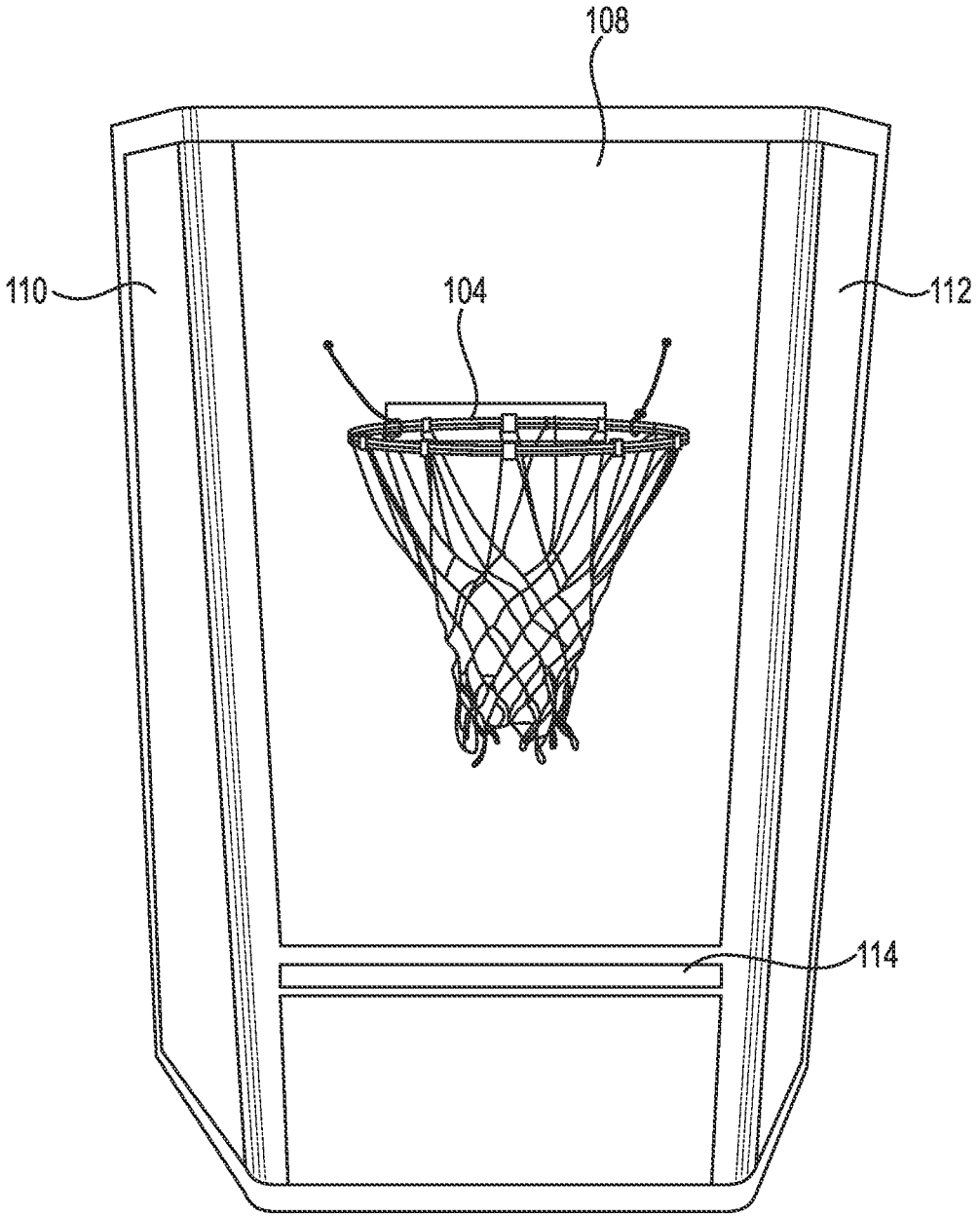
FIG. 10 is a front view of a basketball game system with the hoop folded upwards according to an example embodiment.
Figure 11:
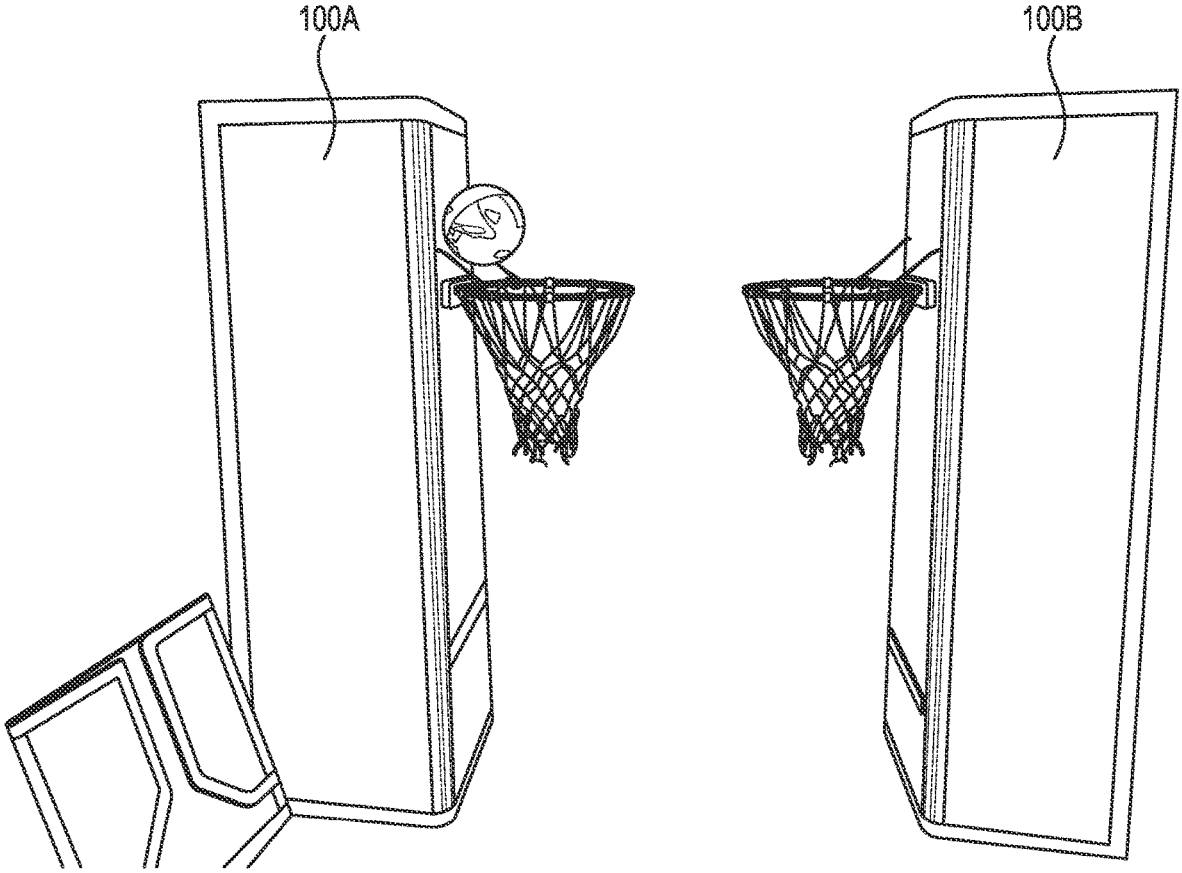
FIG. 11 is a side view of a basketball game system including two backboards and hoops facing one another according to an example embodiment.

The center planar portion 108 of the backboard 102 is preferably 30 inches wide and 65¾ inches tall. Each arm or wing 110 and 112 is also a planar column that is preferably 18 inches wide and the same height as the center section 108. The arms 110 and 112 are pivotably fastened to the center column (via e.g. tape, hinges, etc.) so that they can fold through almost 360 degrees. Thus the arms 110 and 112 can fold flat against the center portion 108 as shown in FIGS. 8-9 and can also fold completely backwards as shown in FIGS. 10-11, or in any other angled configuration.

The hoop 104 is fastened to the center section 108 approximately 17 inches from the center section's top edge. The hoop is preferably 17 inches in diameter.

Figure 3:
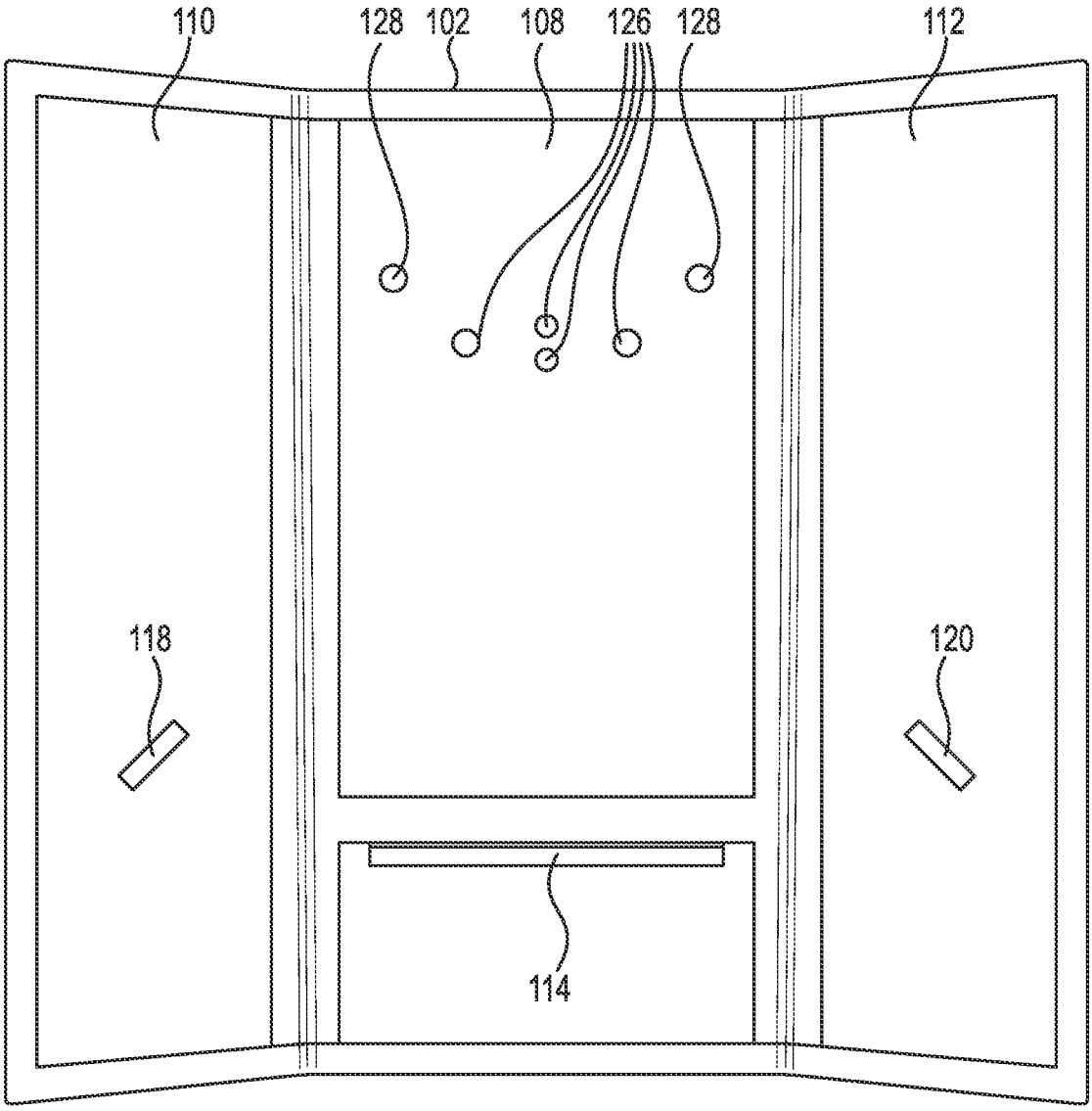
FIG. 3 is a front view of a basketball game system backboard according to an example embodiment.

Referring to FIG. 3, a two-inch wide strip of hook and loop fastener (e.g. VELCRO) 114 approximately 26 inches long is disposed horizontally across the center section 108 at a height of about 15 inches from the bottom edge of the center section 108. This fastener strip 114 is used to fasten an upper flap or flange 116 of the deflector 106 as will be discussed with respect to FIGS. 4-5.

Each arm panel 110 and 112 of the backboard 102 also includes a respective hook and loop fastener (e.g. VELCRO) 118 and 120 for attaching the wings 122 and 124 of the deflector 106 as will be discussed below.

Figure 6:
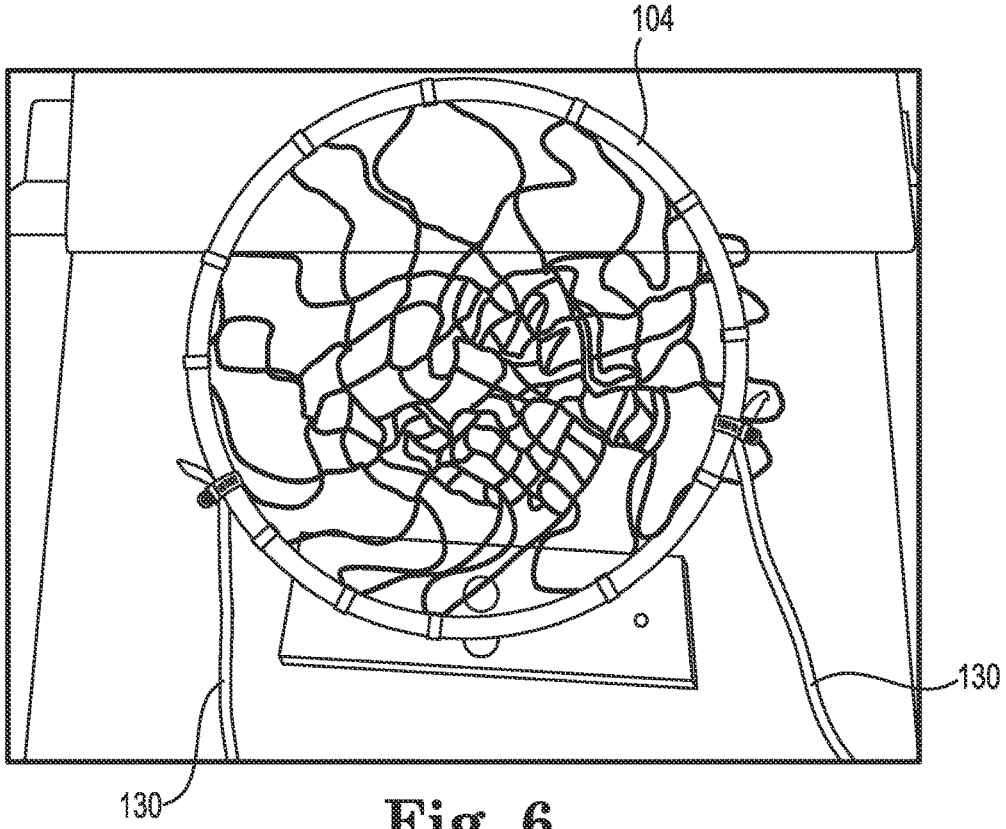
FIG. 6 is a close up view of a folded up hoop mounted to a basketball game system according to an example embodiment.
Figure 7:
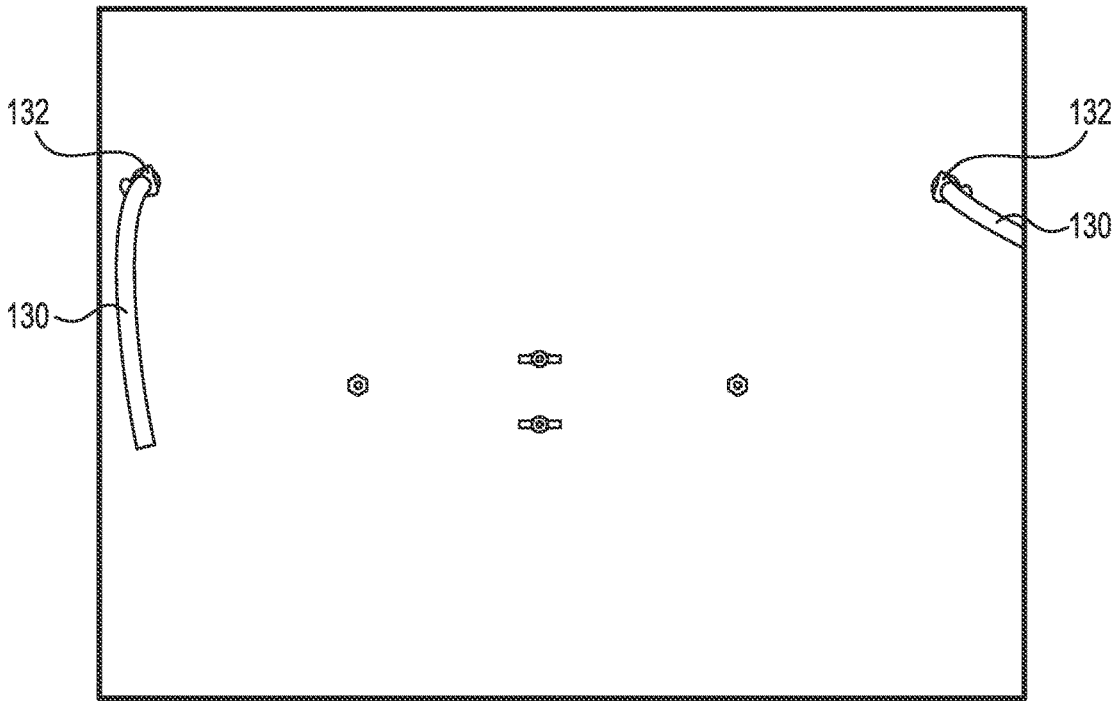
FIG. 7 is a close up view of the hoop mounted to a basketball game system as viewed from the rear of the backboard according to an example embodiment.

Referring to FIGS. 3 and 6-7, the upper portion of the center panel 108 also includes a plurality of mounting holes or apertures 126 that allow passage of fasteners for securely mounting the hoop 104 base to the backboard 102.

Adjacent to the mounting holes 126 is a pair of spaced apart securing holes 128. The securing holes allow for a rope 130 or other conduit to be attached to the hoop's rim (e.g. with pipe clamps) and then fastened behind the backboard 102. Thus, the ropes 130 secure the hoop 104 in the event that the main mounts fail for any reason. The ropes 130 can also be provided with adjustable fasteners 132 on the back side of the center panel 108 so that the hoop can be safely secured against the backboard 102 when the hoop rim is folded up flat against the front side of the center panel 108.

Figure 4:
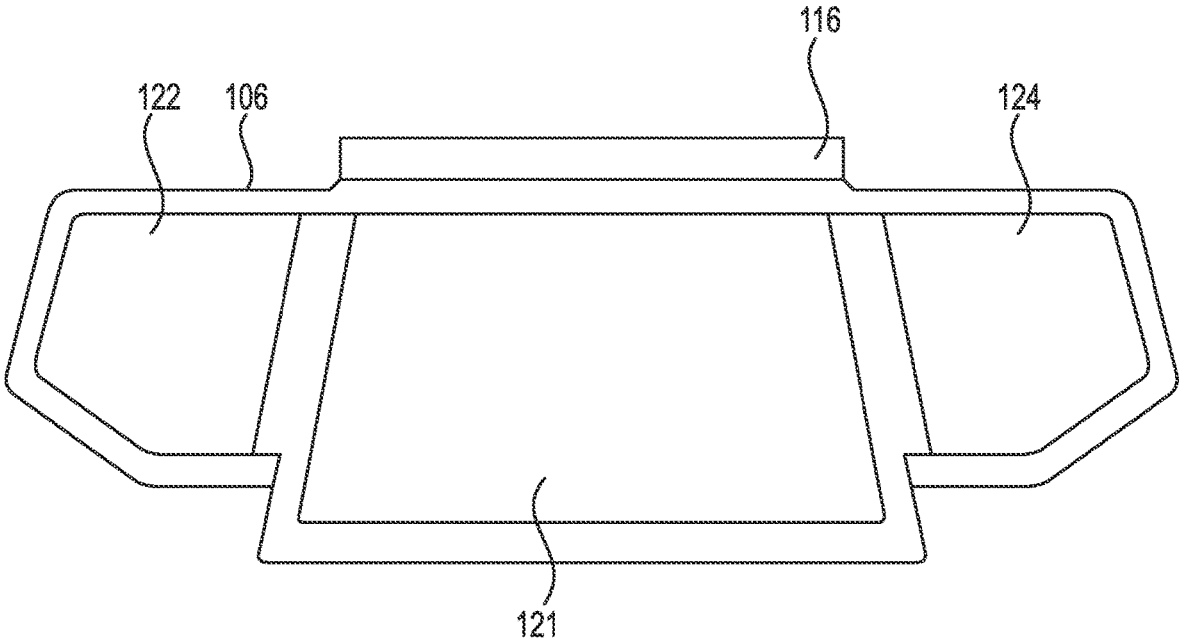
FIG. 4 is a top perspective view of a ball deflector of a basketball game system according to an example embodiment.
Figure 5:
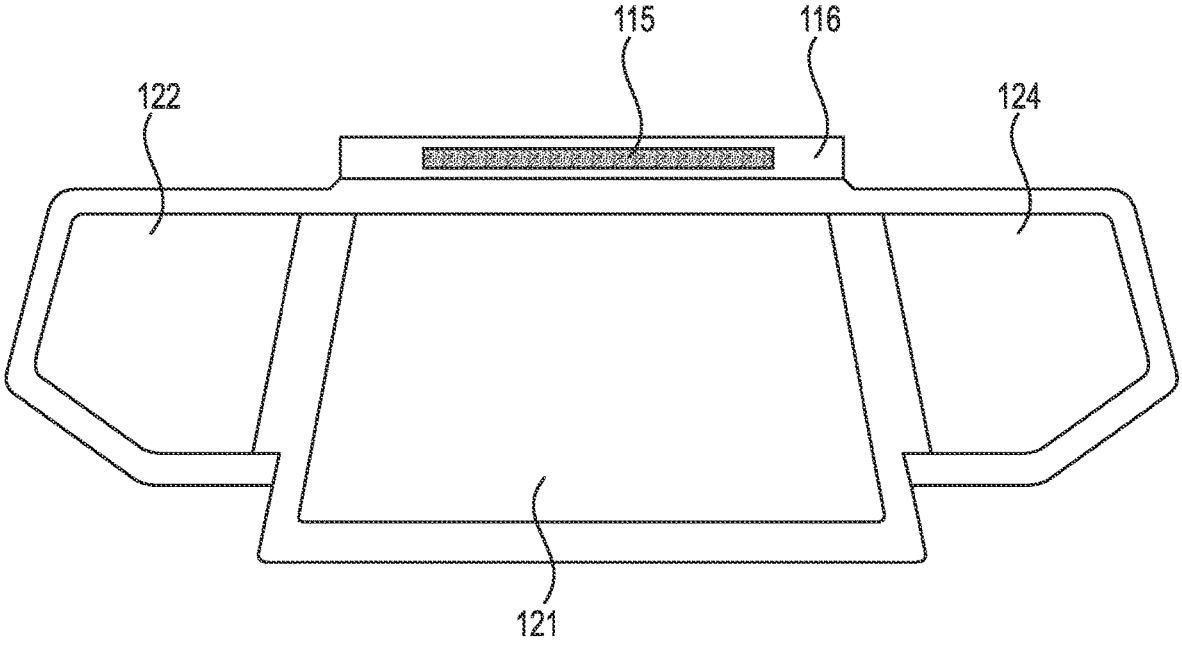
FIG. 5 is a bottom perspective view of a ball deflector of a basketball game system according to an example embodiment.

Referring specifically now to FIGS. 4-5, the deflector 106 also is configured as a tri-panel device comprising a center planar portion 121 with opposing side wings or arms 122 and 124. The wings are preferably about twelve inches wide and the center panel is approximately the same width as the center panel 108 of the backboard 102.

A flap or flange 116 is defined along the top edge of the deflector's center portion 121. The underside of the flap 116 is provided with the opposing hook and loop material 115 so that it can be easily secured to the hook and loop material 114 disposed on the center panel 108 of the backboard 102. Thus, the deflector 106 can be maintained in the deflecting position as shown in FIGS. 1-2.

Figure 2:
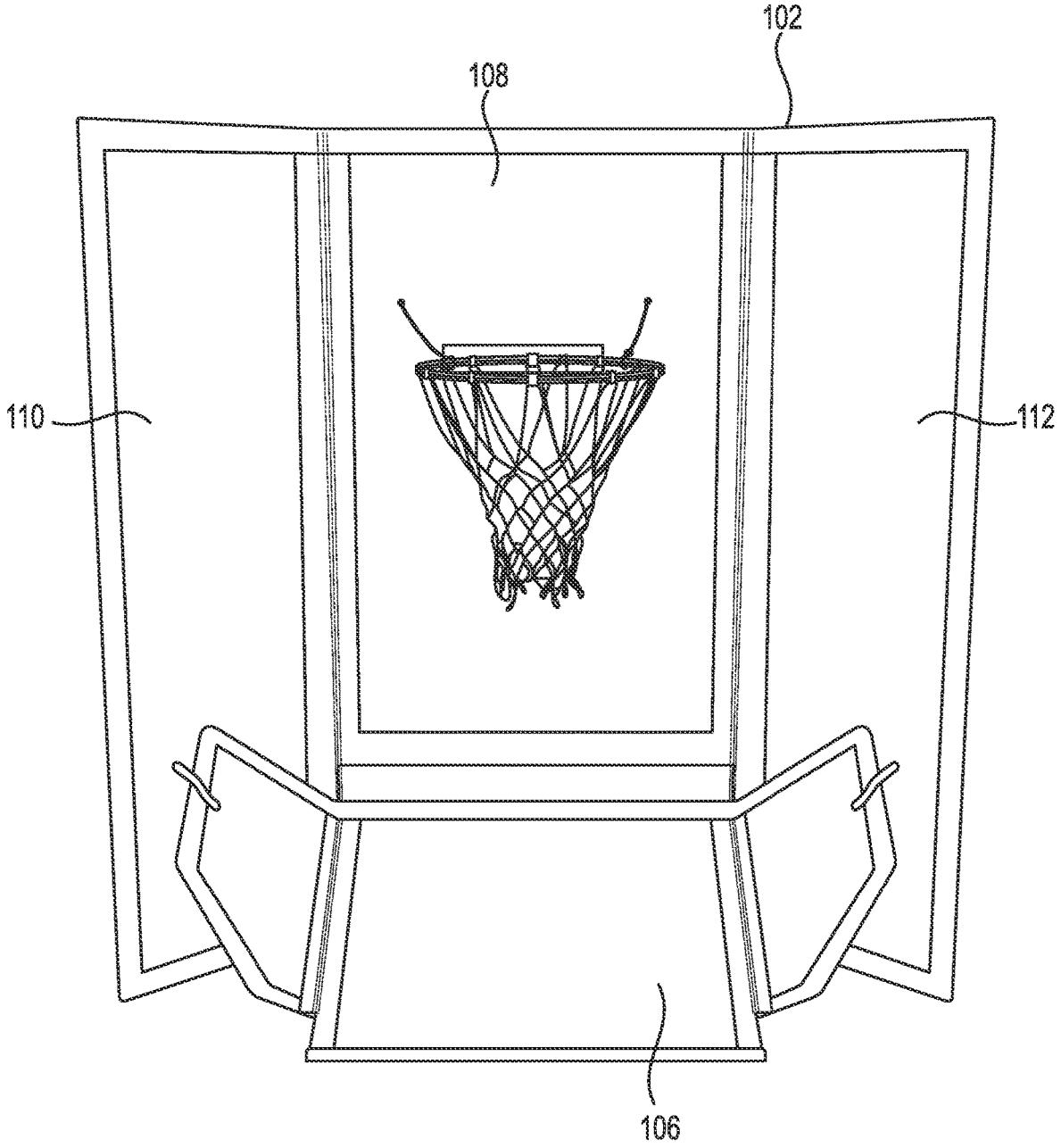
FIG. 2 is a front view of a basketball game system according to an example embodiment.

Each arm 122 and 124 of the deflector 106 also receives a respective portion of hook and loop material so that the arms can be secured to a respective side panel 110 and 112 of the backboard 102 as shown in FIG. 2.

The provision of a large hoop (e.g. 17 inches diameter) enables the player to be more effective, thereby improving the enjoyment of the game. In contrast, most similar games have relatively tiny hoops, which can cause player frustration.

The ball return feature of the present system 100 via the deflector 106 allows repeated shooting without the user worrying about chasing down the ball after every shot.

The side panels 110 and 112 of the backboard can be positioned at various angles with respect to the center panel 108 to accommodate various sizes of floor space and permissible shooting angles. For example, in FIG. 1, each of the side panels 110 and 112 are angled at approximately 90 degrees with respect to the center panel 108. The floor space consumed is fairly minimal, but the permissible shooting angles are mostly from a straight on direction.

In FIG. 2, in contrast, the side panels 110 and 112 are now at an approximate 120 degree angle with respect to the center panel 108. More floor space is consumed as compared to FIG. 1, but a far wider arc of permissible shooting angles is now possible.

FIG. 10 illustrates the side panels 110 and 112 folded behind the center panel 108 (forming a greater than 180 degree angle with respect to the front panel plane). This permits so-called baseline shots to be made at the hoop (i.e. approximately co-planar with the center panel 108, while still providing stability to the system 100. The deflector is not shown as attached in this embodiment, but it certainly could be used by attaching the center hook and loop fasteners 114 and 115 as discussed previously.

FIG. 11 shows two hoop systems 100A and 100B set up to oppose one another to permit a two-way shooting game. It should be understood that the backboards 102 shown in FIG. 11 are shown in a configuration similar to FIG. 10, but could also be configured as in any of the other figures discussed herein and another confirmation without departing from the scope of the invention.

Figure 12:
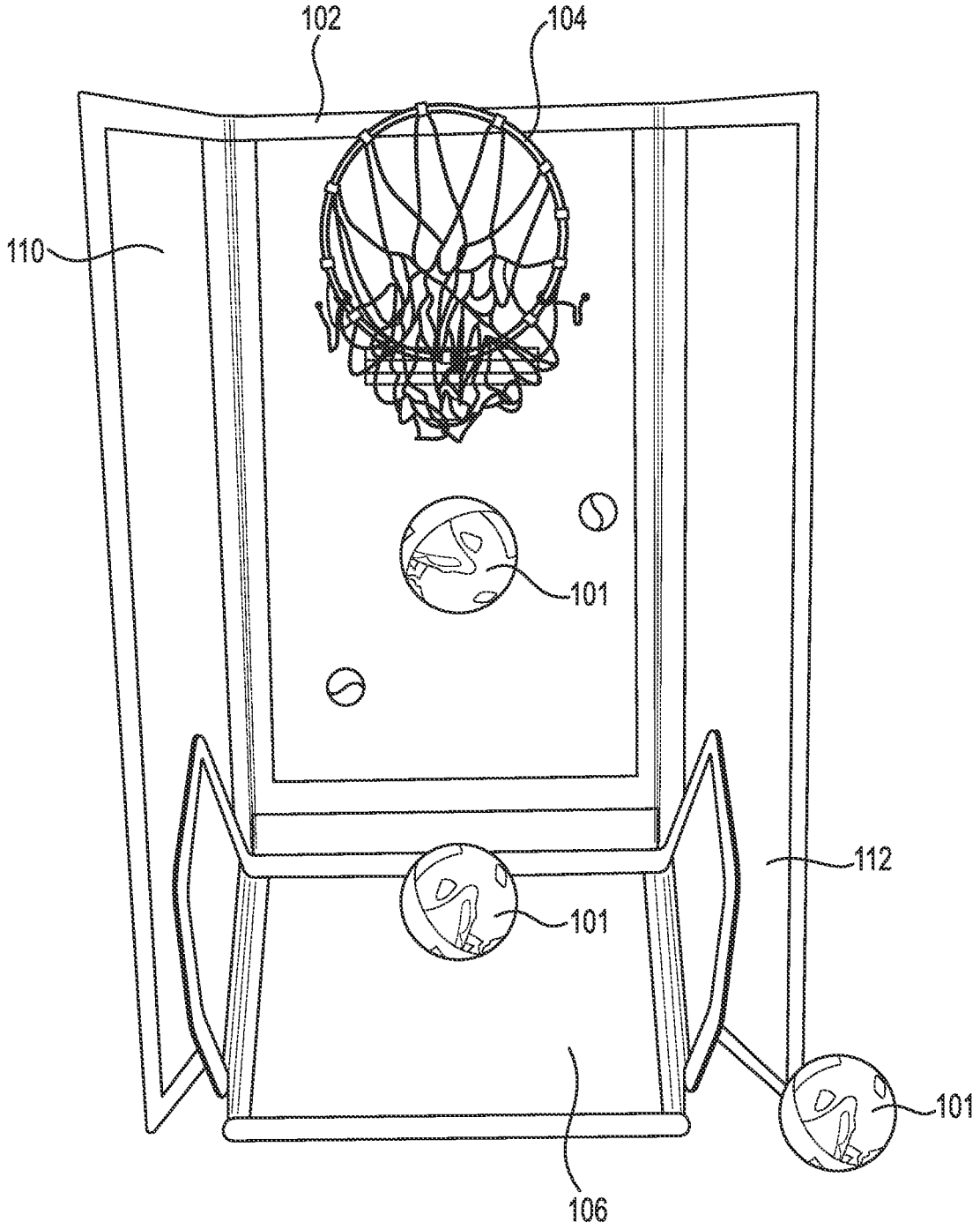
FIG. 12 is a front view of a basketball game system according to an example embodiment.

FIG. 12 illustrates several aspects. In one aspect, the hoop 104 is shown as being folded up against the backboard 102. In another aspect, the basketball 101 is illustrated as falling vertically from the hoop 104 before it contacts the deflector 106 and again just as the deflector is contacted 106. Finally, the ball 101 is shown sitting stationary adjacent to one of the side panels 112 of the backboard.

The present system is also light weight, collapsible and portable. For example it weighs approximately 11 pounds in one embodiment. It can fold flat as shown in the figures, thus enabling quick storage under a bed, behind a couch, or in a closet. The set-up time is about 2-3 minutes even for children.

FIGS. 8 and 9 illustrate the collapsed form of the system 100 according to certain embodiments. The hoop is folded upwards against the front side of the center panel 108. The side panels 110 and 112 are each folded forward one at a time on top of the front side of the center panel 108. The deflector 106 is similarly folded wherein the arms 122 and 124 are folded flat against the center panel 121. The folded system enables easy storage, such as under a bed, behind a couch, in a closet, etc.

The backboard can be used as a backstop for a variety of other games, such as soccer, tennis and softball throw and catch.

The backboard and deflector portions are preferably plastic corrugated boards, fiberglass or other lightweight and rigid material. Such materials are strong and resist dirt, grease and water. The panels are preferably rigid and durable for long-term use. In one embodiment sheets of 3/16"×96"×48" thick polypropylene are used. Alternatively, plywood or similar sheet material can be used. Other plastic, fiberglass or other panel material can be used as well. The panels can also be formed from a combination of materials. For example a metal frame with non-metal panel material can be employed. Any relatively lightweight panel that is resistant to deformation can be employed. Paint and graphics can be applied to enhance the game and add to the visual resemblance to live basketball.

The hoop is preferably steel or strong plastic so that it can withstand rough play without breaking. The net is standard nylon, steel chain or similar.

The system 100 can be scaled to come in various sizes. For example, small, medium and large sizes can be marketed and sold to accommodate different age ranges. The system can also be used on playgrounds or outdoors, such as for example when tailgating at sporting events or at picnics.

In use, the player assembles the system 100 as described herein or as shown in one of the figures. The basketball (either regulation or smaller versions thereof) are shot from the player's selected distance (e.g. up to 12 feet). The deflector 106 returns the ball in the direction of the player to enable easier repeat shooting. Since the ball returns after each shot, basketball players can use this game to improve their shooting skills by practicing hundreds of shots during a short period of time.

It should be appreciated that a mini-basketball game of opposing teams can be played with the present system. Also, any other number of ball games can be played using the system without departing from the scope of the invention.

The system and methods herein allow the user to practice basketball shooting techniques right in his or her own house. This makes practicing more easily available to a variety of users. Hundreds of shots can easily and quickly be practiced because the ball comes right back to the shooter after each shot. Day-care centers, schools, and recreation centers can use this game system for exercise and play-time for young children. The system can be used as entertainment when tail-gating for sporting events, such as before college football games, on the beach, or family and friends gatherings. The system is easily transported because it folds flat, is light weight, and assembles quickly.

In other examples, soccer players can practice kicking the ball against the game since the ball returns after each kick. Baseball players can improve eye-hand coordination by practicing throwing and catching by throwing a rubber ball against the 30"×67" base and catching the ball when it returns. Young children (2 yrs.-4 yrs), can learn hand-eye coordination by throwing the included basketball against the base and catching it as it returns.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. An indoor basketball game system, comprising:

a backboard, the backboard comprising a center section having a front surface and a back surface, a first side section and a second side section, the first side section disposed along a first vertical side edge of the center section and the second side section disposed along an opposing second vertical side edge of the center section, each of the first side section and the second side section being coupled to the center section to pivot with respect to the center section about a vertical axis, the first section adapted to pivot greater than 90 degrees with respect to the center section to enable an off-center arc of shooting;

a ball deflector coupled to the backboard, the ball deflector comprising a center portion, a first arm and a second arm, the first arm disposed along a first side edge of the center portion and the second arm disposed along an opposing second side edge of the center portion, each of the first arm and the second arm coupled to the center portion to pivot with respect to the center portion along a respective first side edge and second side edge of the center portion, the first arm adapted to extend between the first side section and center portion when the first side section is angled 90 degrees or greater; and a basketball hoop assembly disposed on the front surface of the center section of the backboard, the hoop assembly including a rim pivotably coupled to a mounting plate such that the rim can be folded flat against the center section of the backboard, wherein the center portion of the ball deflector is secured to the center section of the backboard such that a plane of the center portion forms an angle of more than 90 degrees with respect to the front surface of the backboard center portion.

2. The system of claim 1, further comprising a section of rope extending through the center section of the backboard and including a first end secured to the rim and a second end secured behind the back surface of the center section.

3. The system of claim 1, wherein the center section defines a width between the first side section and the second side section, wherein the center portion defines a width between the first arm and the second arm, and wherein the width of the center section is the same as the width of the center portion.

4. The system of claim 1, wherein the center portion includes an upper flap pivotably coupled to a top edge of the center portion.

5. The system of claim 4, wherein the upper flap includes a first portion of a hook and loop fastener, and wherein a second portion of hook and loop fastener is disposed on the center section of the backboard so that the deflector can be secured to the backboard.

6. The system of claim 1, wherein the first arm of the ball deflector is secured to the first side section of the backboard and the second arm of the ball deflector is secured to the second side section of the backboard.

7. The system of claim 6, wherein the first arm of the ball deflector is secured to the first side section of the backboard with a first hook and loop fastener, and the second arm of the ball deflector is secured to the second side section of the backboard with a second hook and loop fastener.

8. The system of claim 1, wherein the second side section of the backboard forms an angle with respect to the center section of the backboard of more than ninety degrees and the second arm of the ball deflector adapted to extend between the second side section and center portion when the second side section is angled 90 degrees or greater.

9. The system of claim 1, wherein the center section, first side section and second side section of the backboard all have equal heights.

10. The system of claim 1, wherein the first side section and second side section of the backboard are coupled to the center section of the backboard so that each of the first and second side sections of the backboard can pivot to lie flat against the center section.

11. The system of claim 1, wherein the first arm and second arm of the ball deflector are coupled to the center portion of the deflector so that each of the first and second arms of the ball deflector can pivot to lie flat against the center portion.

12. The system of claim 1, wherein each of the backboard and the deflector comprise a rigid plastic material.

13. The system of claim 1, wherein the hoop has a diameter of 17 inches.

14. An indoor basketball game kit, comprising:

a backboard comprising a center section, a first side section and a second side section, the first side section pivotably secured to the center section along a first side edge of the center section, and the second side section pivotably secured to the center section along an opposing second side edge of the center section;

a ball deflector removably securable to the backboard, the ball deflector comprising a center portion, a first arm and a second arm, the first arm pivotably secured to the center portion along a first side edge of the center portion and the second arm pivotably secured to the center portion along an opposing second side edge of the center portion; and a basketball hoop assembly comprising a rim pivotably coupled to a mounting plate, wherein a plurality of apertures are defined in the center section of the backboard to permit securing of the mounting plate of the hoop assembly to the backboard.

15. The kit of claim 14, wherein the ball deflector includes a fastener to secure the center portion to the backboard such that a plane of the center portion forms an angle of more than 90 degrees with respect to a front surface of the center portion of the backboard.

16. The kit of claim 15, wherein the fastener is a hook and loop fastener.

17. The kit of claim 14, further comprising a section of rope extending through the center section of the backboard and a first fastener to secure a first end of the rope to the rim and a second fastener to secure the second end of the rope against the center section of the backboard.

18. The kit of claim 14, further including a plurality of arm fasteners to secure a respective one of the first and second arms to the first side portion and the second side portion.

19. A method of assembly and use of an indoor basketball hoop, the method comprising:

providing a backboard center section, the center section defining a first vertical edge, an opposing second vertical edge, a front surface and a rear surface;

securing a first side section to the backboard center portion along the first vertical edge such that the first side section can pivot about the first vertical edge with respect to the center section, the first side section adapted to be angled greater than 90 degrees with respect to the center section to enable an off-center arc of shooting;

securing a second side section to the backboard center portion along the second vertical edge such that the second side section can pivot about the second vertical edge with respect to the center section;

securing a ball deflector to the backboard center section such that the ball deflector intersects with the center section to form an angle of greater than 90 degrees therebetween;

securing a basketball hoop assembly to the backboard center section via a plurality of fasteners extending through the backboard center section;

shooting a basketball at the hoop assembly;

contacting the hoop assembly with the basketball;

deflecting the basketball towards a location where the basketball was shot after the basketball contacted the hoop assembly; and further comprising securing a first arm to the ball deflector along a first side edge of the ball deflector such that the first arm can pivot with respect to the ball deflector more than 90 degrees while maintaining contact with the first side section of the backboard;

securing a second arm to the ball deflector along a second side edge of the ball deflector such that the second arm can pivot with respect to the ball deflector; securing the first arm to the first side section; and securing the second arm to the second side section.

* * * * *